United States Patent [19]

Johnson

[11] Patent Number: 4,515,046

[45] Date of Patent: May 7, 1985

[54] RETRACTABLE TORQUE APPLYING TOOL

[76] Inventor: Gilbert Johnson, 3561 N. Leroy St., San Bernardino, Calif. 92404

[21] Appl. No.: 465,038

[22] Filed: Feb. 8, 1983

[51] Int. Cl.[3] ..... B25G 1/08

[52] U.S. Cl. ..... 81/436; 81/177 E

[58] Field of Search ..... 145/64; 81/436

[56] References Cited

U.S. PATENT DOCUMENTS

| | | | |
|---|---|---|---|
| 1,503,047 | 7/1924 | Hendrickson | 145/64 |
| 3,137,276 | 6/1964 | Weisser | 120/42.03 |
| 3,315,395 | 4/1967 | Kirklen | 40/334 |
| 3,652,173 | 3/1972 | Miller et al. | 401/110 |
| 3,657,812 | 4/1972 | Lee | 145/64 |

*Primary Examiner*—James G. Smith
*Assistant Examiner*—J. T. Zatarga
*Attorney, Agent, or Firm*—Lowe, King, Price & Becker

[57] ABSTRACT

Method and apparatus are disclosed for advancing and retracting a torque applying tool to and from an operative position. The disclosed apparatus, which includes a push button retracting mechanism, includes structure for transmission of bidirectional torque between its housing and the tool. Screwdrivers and other torque applying tools may thus be driven by rotation of the apparatus housing.

16 Claims, 9 Drawing Figures

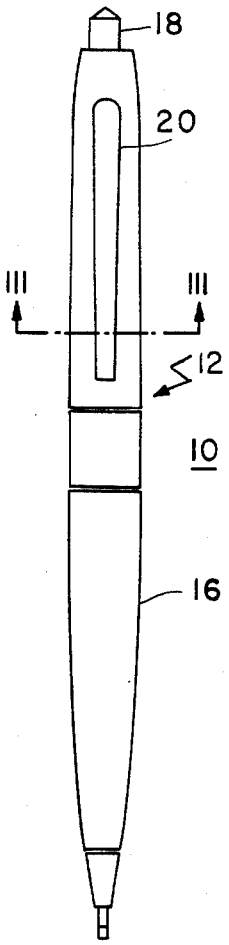
FIG. 1
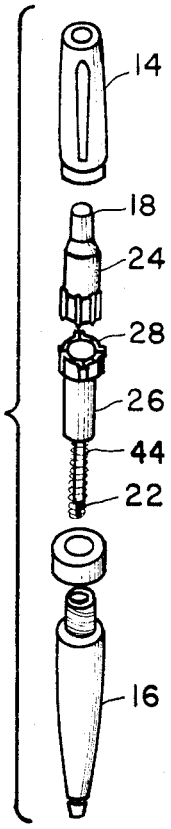
FIG. 2
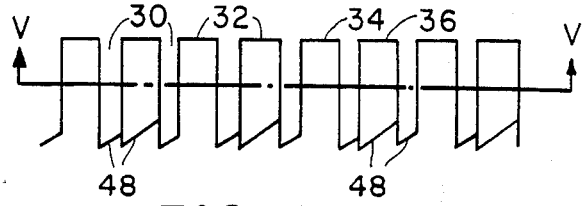
FIG. 4
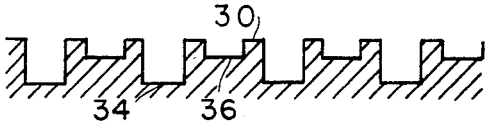
FIG. 5
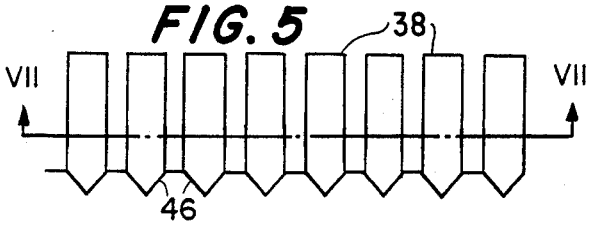
FIG. 6
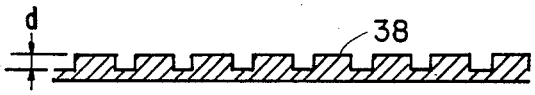
FIG. 7
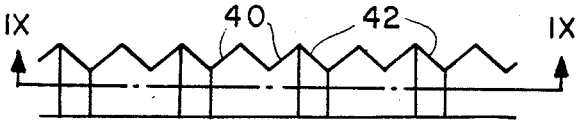
FIG. 8
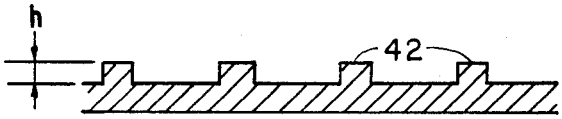
FIG. 9
FIG. 3
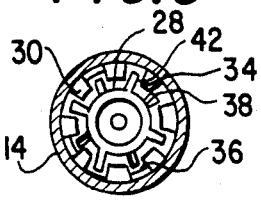

RETRACTABLE TORQUE APPLYING TOOL

BACKGROUND OF THE INVENTION

This invention relates to hand tools, and more specifically to torque applying hand tools easily retractable into a housing.

Torque applying hand tools, such as screwdrivers, are well known in the art. It is also known to provide small dimensioned screwdrivers, useful for tightening eyeglass rims and lenses, for example, or for adjustment of miniaturized electronic or mechanical equipment. Such miniaturized, or pocket screwdrivers, do not enjoy widespread distribution, however, because of difficulty in carrying the same in a pocket or purse. That is, such miniature screwdrivers may typically damage clothing or cause puncture wounds to a user.

Application of a cap to such miniaturized pocket tools fails to alleviate the problem inasmuch as such caps tend to become dislodged, misplaced, or lost. The miniature tool is thus again dangerous to its user and surroundings.

There is accordingly a need in the prior art for tools, such as screwdrivers, in safety housings.

It is known to provide a retractable arrangement for a cosmetics applicator in a housing, having an exposed operative position and a retracted, concealed, inoperative position. However, a cosmetics applying brush is not designed for application of torque. Accordingly, a retractable apparatus known for a cosmetics application cannot be used in conjunction with torque applying tools, such as screwdrivers.

There is accordingly a need in the prior art to provide a housing having a retraction and propulsion apparatus applicable for a torque applying tool.

There is thus a need in the prior art for a simply operated, easily manipulated device for advancing and retracting a hand-held tool within a housing in a non-damaging torque transmitting arrangement.

SUMMARY AND OBJECTS OF THE INVENTION

It is accordingly an object of the invention to overcome the difficulties of the prior art and to provide torque transmitting apparatus for a retractable tool.

It is a more specific object of the invention to provide a retractable tool having a housing arranged in a torque transmitting configuration therewith.

Still another object of the invention is the provision of a rapidly retractable screwdriver within a protective housing therefor.

A further object of the invention is the provision of a method for applying a torque to a retractable tool mounted in a housing wherein the tool may be advanced to and retracted from an operable position.

In accordance with the foregoing objects of the invention, there is provided a retractable screwdriver including a housing incorporating a gear rigidly attached thereto. A first geared cam, rigidly attached to a rear portion of the screwdriver, engages the housing gear in an advanced position of the screwdriver. The first geared cam maintains a substantially fixed angular displacement between the screwdriver and the housing. A manually operable plunger means rapidly advances and retracts the screwdriver, and includes a second geared cam for engaging the housing gear. The second geared cam establishes a substantially fixed angular displacement between the plunger and the housing, and further cammingly contacts the first geared cam to advance the tool to the operative position thereof.

A number of camming surfaces may be distributed along a rearward surface of the first geared cam, and a plurality of cams may be distributed along a forward surface of the second geared cam.

In accordance with another aspect of the invention, there is provided a method for applying torque to a retractable tool mounted in a housing and having first and second geared cams and a manually operable plunger as hereinabove described. The inventive method comprises the steps of operating the plunger to advance the tool to its operable position. A torque transmitting connection is established between the housing and the tool in the operable position, and torque is applied to the housing.

In establishing the torque transmitting connection, the first geared cam may be caused to engage the gear attached to the housing in order to maintain a substantially rigid relative displacement between the housing and the tool. The method may further comprise the step of retracting the tool after application of torque thereby. Additionally, the step of applying the torque to the housing may comprise rotation of the housing for advancing or withdrawing a screw engaged by a screwdriver.

In accordance with yet another aspect of the invention there is provided a retractable tool including a housing. The housing provides a stable engagement for the tool as well as a housing therefor in a retracted position. The stable engagement between the housing and the tool provides a stable basis to an exposed implement of the tool when in an advanced position. A propelling means non-rotationally engages the housing for advancing and retracting the tool to expose and withdraw its implement. A stabilizing means engages the propelling means and the tool, thereby to stabilize the tool within the housing and to prevent relative rotation between the tool and housing.

Preferably, the tool comprises a screwdriver and the implement thereof comprises a bit exposed and withdrawn by advancement and retraction of the screwdriver within the housing. Additionally, the stabilizing means preferably comprises a torque transmitting means for stably engaging the screwdriver to the housing, thereby transmitting rotational torque from the housing to the screwdriver.

The torque transmitting means preferably comprises first and second structures rigidly attached to the screwdriver and to the housing, arranged for engagement with each other to maintain a substantially fixed angular relationship between the screwdriver and the housing in an advanced position of the screwdriver. Such a fixed angular relationship provides for torque transmission between the housing and the screwdriver.

These and other features, objects and advantages of the present invention will become more readily apparent to those skilled in the art from the following description wherein there is shown and described a preferred embodiment of the invention, simply by way of illustration of one of the best modes contemplated for carrying out the invention. As will be realized, the invention is capable of other, different embodiments, and its several details are capable of modifications in various obvious aspects, all without departing from the invention. Accordingly, the drawings and descriptions herein will be regarded as illustrative in nature and not as restrictive.

BRIEF DESCRIPTION OF THE DRAWING

The accompanying drawings, incorporated in and forming a part of the specification, illustrate several aspects of the present invention and, together with the description, serve to explain the principles of the invention. In the drawings:

FIG. 1 shows a plan view of a retractable tool apparatus in accordance with the invention;

FIG. 2 shows an exploded view of the components of the invention incorporated in the structure of FIG. 1;

FIG. 3 shows a sectional view of a cap portion of the structure of FIG. 1;

FIG. 4 shows an expanded view of the inner surface of a cap of the invention shown in FIG. 2;

FIG. 5 shows a sectional view taken along lines V—V of FIG. 4;

FIG. 6 shows an expanded view of an outer surface of a plunger of the invention shown in FIG. 2;

FIG. 7 shows a sectional view taken along lines VII—VII of FIG. 6;

FIG. 8 shows an expanded view of an outer surface of a torquer of the invention shown in FIG. 2; and FIG. 9 shows a sectional view taken along lines IX—IX of FIG. 7.

DETAILED DESCRIPTION OF A PREFERRED EMBODIMENT

Referring now to the view of the invention shown in FIG. 1, there is generally illustrated at 10 a retractable tool, and preferably a retractable screwdriver, in accordance with the invention.

The inventive structure is seen to include a housing 12 having a cap 14, a body 16, a pushbutton 18, a pocket-engaging clip 20 and an implement at the forward end of the tool, preferably a screwdriver bit 22. The inventive structure may be clipped to a user's pocket, or elsewhere, by means of the clip 20. In use, the screwdriver bit 22 is advanced to its operative position by depressing pushbutton 18.

In its operative position, bit 22 may engage an appropriately shaped screw head, torque being applied to the screw by digital manipulation of housing 12, for example. A screw may thus be tightened or loosened, for example, by rotation of housing 12.

A subsequent depression of pushbutton 18 causes screwdriver bit 22 to be retracted from the screw into housing 12. Thus, in its retracted position, the tool bit is unaccessible for damaging clothing, puncturing the user's skin or the like.

In order to function properly as a tool, it is noted that rotation of the housing is transmitted to the screwdriver bit. Specifically, torque applied to the housing 12 is transmitted to the tool.

A structure by which such torque transmission may take place is shown in the exploded view of FIG. 2, showing the various components of the retractable tool shown in FIG. 1. As shown therein, a plunger 24 is used to propel tool 26 within the body 16 of the housing.

Although tool 26 is described in terms of a screwdriver, it should be understood that other tools may be similarly employed in the invention, and that the use of a screwdriver is illustrative only. For example, standard and Philips head screwdrivers may be used; nut drivers may be used; scrapers and other similar devices may also be used in conjunction with the invention.

The structure shown in FIG. 2 cooperates with a further component for transmission of torque from the housing to the tool. A housing gear, shown in the sectional view of FIG. 3, comprises a plurality of slots provided along the inner surface of cap 14. The slots may be formed on the inner surface of cap 14, or may alternatively be provided in a separate component rigidly attached to the inner portion of the cap.

Plunger 24 is engaged by the slots formed in cap 14 and is restrained thereby to longitudinal motion. The plunger is thus prevented from rotation with respect to the housing. A torquer 28 is axially displaced by plunger 24 within housing 12. Torquer 28 is rigidly attached to tool 26. Torquer 28 further includes structural ridges for engaging the slots in the housing gear, thereby providing for non-rotational positioning of the torquer with respect to the housing. That is, the torquer and hence the tool is prevented from rotation with respect to housing 12 by the disclosed structure. Thus, by providing a fixed angular displacement between the torquer 28 and housing 12, rotation of housing 12 leads to rotation of tool 26. Torque applied to housing 12 is thus transmitted via the housing bearing and the torquer to the tool 26.

Operation of the structure shown in FIG. 2 may best be understood with reference to FIGS. 4–9, wherein there are shown expanded views of the surfaces of the cap, the plunger and the torquer, as well as sectional views thereof.

If it is imagined that cap 14 is slit longitudinally and unrolled to provide a flat surface, its inner portion would appear as shown in FIG. 4. Therein, a plurality of ridges 30 formed on the inner surface of the cap define a number of slots 32.

Two types of slots are formed in a housing bearing. Deep slots 34 and shallow slots 36 alternate along the peripheral surface of the housing bearing. As seen in the sectional view of FIG. 5, each pair of successive ridges defines either a deep or a shallow slot therebetween.

A similar "unfolding" or expansion, of the outer surface of plunger 24 in FIG. 6 (not to scale) shows a number of ridges 38 formed therein. Ridges 38 are formed to fit and slide within slots 32 of the housing bearing.

As seen from the sectional view of FIG. 7, alternate ones of ridges 38 engage deep and shallow slots 34 and 36 of the housing gear formed in cap 14. Ridges 38 are appropriately dimensioned, at "d" in FIG. 7 taking into account the radius of the outer surface of plunger 24 and the inner surface of cap 14, to fit within the shallow slots 36, thus assuring fit within the deep slots 34 of FIG. 5.

Referring now to FIG. 8, the "unfolded" outer surface of torquer 28 is seen to include a number of teeth shown at 40. Ridges 42 are provided at alternate ones of teeth 40, the ridges protruding from the surface of torquer 28 by a distance "h" of FIG. 9, which is excessively large to fit within shallow slots 36, but sufficiently small to fit within deep slots 34. Thus, torquer 28, when rotated to an orientation wherein ridges 42 are located opposite slots 36 will not slide longitudinally within the slots. A spring 44, seen in FIG. 2, provides a biasing upward force, in a direction to retract tool 26, against the tool and torquer 28. Accordingly, when ridges 42 are located opposite deep slots 34 torquer 28 and tool 26 will slide upwardly within housing 12. Torquer 28 engages plunger 24 and pushes the same upwardly.

As further seen in FIG. 6, plunger 24 includes a plurality of cams, formed as descending teeth 46 therein.

Teeth 46 cooperate with the camming surfaces formed by ridges 42 of torquer 28 in the following manner.

When ridges 38 of plunger 24 and ridges 42 of torquer 28 are aligned within slots 34 of the housing bearing, teeth 46 and 40 are misaligned with respect to one another. Such an arrangement causes torquer 28 to rotate to the left in FIG. 8 (clockwise from the top of FIG. 2) with respect to plunger 24 when ridges 42 are disengaged from slots 34 of the housing gear. The angles of the teeth 40 and 46 are chosen to provide a sufficient rotation of torquer 28 so that upon disengagement of pushbutton 18 a further interaction takes places between the torquer and the housing gear. Specifically, the bottoms of ridges 30 and shallow slots 36 of the housing gear are both provided with cam surfaces 48 for engaging the camming surfaces of teeth 42 of torquer 28. Thus, upon progressing upwardly under the biasing force of spring 44, the camming surfaces of torquer 28 encounter camming surfaces 48 of the housing gear, thus causing further rotation of the torquer until ridges 42 thereof are positioned opposite shallow slots 36. Under the action of spring 44 the torquer progresses upwardly for a short distance, until ridges 42 engage the shallow slots 36 and can no longer progress therethrough. At this point the tool is in its forwardly extended, exposed position. The top portion of each of the ridges 42, however, is locked into the bottom portion of each of the shallow slots 36. Thus, torquer 28 cannot rotate within housing 12. More particularly, the tool 26, fixedly attached to torquer 28, is thus rigidly connected to housing 12 for torque transmission therebetween. Thus, upon each activation of pushbutton 18 the tool will rotate, establish a fixed angular position with respect to the housing, and alter its position from advanced to retracted and vice versa. Because a plurality of ridges and slots are used within the housing bearing and the torquer component, it is seen that pressure is evenly distributed along the ridges so that the tool, in its advanced position, is capable of withstanding substantial torque transmission from the housing.

It is noted that the present apparatus thus provides bidirectional torque transmission between the housing and the tool.

There has thus been described in the foregoing specification a method and apparatus for applying torque to a retractable tool. The foregoing description of a preferred embodiment of the invention, however, has been presented for purposes of illustration and description and is not intended to be exhaustive or to limit the invention to the precise form disclosed. Obviously many modifications and variations are possible in the invention in light of the above teaching. For example, instead of using a compression spring there may be provided a tensile spring for a differently arranged tool within the housing. Similarly, the housing gear may be provided in association with the body rather than the cap of the housing. Moreover, the torquer 28 may be formed as part of the tool or may be separately formed for attachment thereto. Where separately formed, the shaft of tool 26 may be formed with a plurality of flat edges, thus providing a polygonal cross-section to enhance attachment to the torquer or to reduce the possibility of relative rotation therebetween.

The embodiment disclosed in the specification was chosen and described in order best to explain the principles of the invention and its practical application, thereby to enable others skilled in the art best to utilize the invention in various embodiments and with various modifications as are suited to the particular use contemplated. It is intended that the scope of the invention be defined by the claims appended thereto.

I claim:

1. A retractable screwdriver comprising:

housing means incorporating a gear rigidly attached thereto, for housing said screwdriver;

first geared cam means rigidly attached to a rear end portion of said screwdriver for engaging said housing gear in an advanced position of said screwdriver, and for maintaining a substantially fixed angular displacement between said screwdriver and said housing means, manually operable plunger means for rapidly advancing and retracting said screwdriver, including second geared cam means having means for engaging said housing gear, thereby establishing a substantially fixed angular displacement between said plunger means and said housing means, said second geared cam means having further means for cammingly contacting said first geared cam means thereby to advance said tool to an operable position.

2. A retractable screwdriver as recited in claim 1 wherein said first geared cam means comprises a plurality of camming surfaces distributed along a rearward surface thereof and said further means of said second geared cam means comprises a plurality of cams distributed along a forward surface thereof.

3. A method for applying torque to a retractable tool mounted in a housing, the tool having a first geared cam rigidly attached to a rear end portion thereof for engaging a gear rigidly attached to said housing and for maintaining a substantially fixed angular displacement between said tool and said housing, a manually operable plunger including a second geared cam for engaging said gear attached to said housing and for cammingly contacting said first geared cam to advance said tool to an operable position, comprising the steps of:

(a) operating said plunger to advance said tool to its operable position;

(b) establishing a torque transmitting connection between said housing and said tool in its operable position; and (c) applying torque to said housing.

4. The method recited in claim 3 wherein said establishing step comprises the further step of causing said first geared cam to engage said gear attached to said housing thereby to maintain a substantially rigid relative displacement between said housing and said tool.

5. The method recited in claim 3 comprising the further step of retracting said tool after application of torque thereby.

6. The method recited in claim 3 wherein said tool comprises a screwdriver and said applying step comprises the step of manually rotating said housing for advancing or withdrawing a screw engaged by said screwdriver.

7. A retractable tool comprising:

housing means for housing said tool in a retracted position and for providing a stable engagement therefor, thereby providing a stable basis to an exposed implement of said tool in an advanced position;

propelling means non-rotationally engaging said housing means for advancing and retracting said tool to expose and withdraw the implement thereof; and stabilizing means for engaging said propelling means and said tool thereby to stabilize said tool within said housing and to prevent relative rotation between said tool and said housing wherein said tool comprises a screwdriver and said implement comprises a bit exposed and withdrawn by advancement and retraction of said screwdriver within said housing, and wherein said stabilizing means comprises torque transmitting means for stably engaging said screwdriver to said housing means thereby transmitting rotational torque from said housing means to said screwdriver.

8. A retractable screwdriver as recited in claim 1 wherein said torque transmitting means comprises:

first structure rigidly attached to said screwdriver;

second structure rigidly attached to said housing;

said first and second structures each arranged for engagement with the other for maintaining a substantially fixed angular relationship between said screwdriver and said housing in an advanced position of said screwdriver, thereby to provide torque transmission between said housing and said screwdriver.

9. A retractable screwdriver as recited in claim 8 wherein said propelling means comprises plunger means having a manually engageable extension, and said housing comprises a cap means having an opening therein for passage of said manually engageable extension therethrough.

10. A retractable screwdriver as recited in claim 9 wherein said propelling means comprises means for engaging said second structure for maintaining a substantially fixed angular relationship between said propelling means and said housing and further comprising a plurality of cams distributed along a forward surface thereof, said first structure including a plurality of camming surfaces distributed along a rearward surface thereof to provide a camming arrangement for advancing and retracting said screwdriver upon engagement of said first and second structures, said propelling means being operable for propelling said screwdriver longitudinally to cause said first and second structures to engage each other at least in the advanced position of said screwdriver, thereby providing for transmission of torque between said housing and said screwdriver when said screwdriver is in its advanced position.

11. A retractable screwdriver as recited in claim 10 wherein said camming surfaces comprise a plurality of backwardly pointing teeth, said cams comprise a plurality of forwardly pointing teeth arranged to be misaligned with said backwardly pointing teeth upon engagement of said first structure and said means for engaging with said second structure.

12. A retractable screwdriver as recited in claim 8 wherein said propelling means comprises plunger means for advancing said screwdriver within said housing means, said plunger means engageable with said screwdriver and incorporating said first structure, said propelling means further comprising spring means engaging said housing means and said screwdriver for applying a biasing force to said screwdriver in a rearward direction, thereby providing a retracting force thereto.

13. A retractable screwdriver as recited in claim 1 wherein said housing means includes a detachable cap structure and said rigidly attached gear includes alternating interior deep and shallow slots separated by ridges, wherein said manually operable plunger means includes a pushbutton structure extending rearwardly from said cap, said first geared cam means comprising torquer means including a plurality of exterior ridges for engaging said interior slots of said cap, said first geared cam means further including a plurality of teeth forming a plurality of camming surfaces along a rearward surface thereof, said means for engaging said housing gear in said second geared cam means comprising a plurality of exterior ridges formed on said plunger means for engaging said interior slots of said cap, said further means of said second geared cam means comprising a plurality of teeth for engaging said plurality of teeth provided on said torquer means, said plurality of teeth of said torquer means and said plurality of teeth on said second geared cam means arranged relatively to the respective ridges thereof to provide misaligned contact therebetween.

14. A retractable screwdriver as recited in claim 13 wherein said ridges and slots of said housing gear form a toothed structure providing a locking mechanism for said ridges and teeth of said torquer means, thereby locking said torquer means and said screwdriver attached thereto in an extended or a retracted position.

15. A retractable screwdriver as recited in claim 13 wherein said manually operable plunger means includes means for converting longitudinal force applied thereto to a rotation of said screwdriver and said first geared cam means from a position wherein said exterior ridges of said torquer means are disposed adjacent said shallow slots to a position wherein said exterior ridges of said torquer means engage said deep slots of said housing means.

16. A retractable screwdriver as recited in claim 1 wherein said manually operable plunger means includes means for converting longitudinal force applied thereto to a rotation of said screwdriver and said first geared cam means from an advanced position of said screwdriver to a retracted position thereof, and from a retracted position to an advanced position.

* * * * *